United States Patent [19]

Wirtz et al.

[11] Patent Number: 5,056,725

[45] Date of Patent: Oct. 15, 1991

[54] ASSEMBLY FOR READYING YARN PACKAGES FOR UNWINDING AT A TEXTILE WINDING MACHINE

[75] Inventors: Ulrich Wirtz; Helmut Hensen, both of Moenchengladbach; Helmut Kohlen, Erkelenz; Paul Surkamp, Kempen; Hans Grecksch; Dietmar Engelhardt, both of Moenchengladbach, all of Fed. Rep. of Germany

[73] Assignee: W. Schlafhorst & Co., Monchengladbach, Fed. Rep. of Germany

[21] Appl. No.: 537,363

[22] Filed: Jun. 13, 1990

[30] Foreign Application Priority Data

Jun. 15, 1989 [DE] Fed. Rep. of Germany ..... 3919542

[51] Int. Cl.[5] ..... B65H 54/20; B65H 67/06

[52] U.S. Cl. ..... 242/35.50 A; 242/18 R; 242/35.50 R; 242/35.60 E

[58] Field of Search ..... 242/35.5 A, 35.5 R, 242/18 R, 35.6 E

[56] References Cited

U.S. PATENT DOCUMENTS

| | | | |
|---|---|---|---|
| 4,544,107 | 10/1985 | Matsui et al. | 242/35.5 A |
| 4,576,341 | 3/1986 | Matsui et al. | 242/35.5 A |
| 4,616,789 | 10/1986 | Matsui et al. | 242/35.5 R |
| 4,681,271 | 7/1987 | Matsui et al. | 242/18 R |
| 4,781,334 | 11/1988 | Derichs | 242/35.5 A |
| 4,798,348 | 1/1989 | Matsui et al. | 242/35.6 E |
| 4,896,841 | 1/1990 | Topuett | 242/35.6 E |
| 4,901,931 | 2/1990 | Mista | 242/18 R |
| 4,911,371 | 3/1990 | Mista | 242/35.6 E |
| 4,921,179 | 5/1990 | Surkamp et al. | 242/18 R |

*Primary Examiner*—Stanley N. Gilreath

*Attorney, Agent, or Firm*—Shefte, Pinckney & Sawyer

[57] ABSTRACT

A yarn package handling assembly is provided for handling yarn packages transported on individual package support members on a textile winding machine. The yarn package handling assembly includes a yarn end disposing arrangement operable to dispose the yarn ends of yarn packages into preferred preliminary dispositions for handling at the winding stations of the machine. Another yarn end disposing arrangement is provided for more aggressively acting on yarn packages to dispose their yarn ends in a preferred preliminary disposition where the first arrangement was unsuccessful, handling yarn packages in a special manner to dispose their yarn ends in a preferred preliminary disposition and the yarn packages prepared by the more aggressive yarn end disposing arrangement are transported along a second transport path back to the path for feeding packages from the first-mentioned arrangement to the winding stations. According to one aspect of the present invention, a tube stripping device can be provided for stripping yarn from tubes. According to another aspect of the present invention, a yarn amount sensing member senses the presence of yarn on tubes discharged from the winding stations and controls recirculates those tubes having more than a minimum amount of yarn to the more aggressive yarn end disposing arrangement.

19 Claims, 2 Drawing Sheets

ASSEMBLY FOR READYING YARN PACKAGES FOR UNWINDING AT A TEXTILE WINDING MACHINE

BACKGROUND OF THE INVENTION

The present invention relates to an assembly for readying yarn packages for unwinding at a textile winding machine.

The improved capability of newer commercially available textile spinning machines to produce a relatively high output of yarn packages has placed a corresponding demand on textile winding machines of the type operatively connected with such relatively high output spinning machines to efficiently and relatively rapidly perform winding operations on the yarn packages delivered thereto from the spinning machines. Increases in the productivity of such winding machines must be created not only through improvements of the winding stations which unwind the yarn from the yarn packages but also through improvements in the other components of the winding machine, such as components which ready the yarn packages for winding at the winding stations, components which deliver yarn packages from a yarn package receiving location to the winding stations and components which deliver empty tubes from the winding stations to a removal location. A closed transport loop configuration on the winding machine and devices for directly transferring yarn packages from a spinning machine to a winding machine are two examples of improvements in the production capability of spinning and winding machines.

At some location between the spinning station at which a yarn package is built and the winding station at which yarn from the yarn package is unwound, the yarn package must undergo a yarn end readying process in which the yarn end is disposed in a preferred preliminary disposition for ready engagement at the winding station. While it is widely known to provide a device for finding and preparing a yarn end of a yarn package at a suitable location on the winding machine, experience has shown that it is virtually impossible for one such device to successfully find and ready the yarn end of every yarn package which is handled thereby. Thus, a certain percentage of yarn packages delivered to the winding machine must be further handled to insure that the yarn end of every package arriving at a winding station for unwinding thereat is disposed in a preferred preliminary disposition for engagement at the winding station.

In German Patentschrift 30 45 825, a yarn end readying process is proposed in which those yarn packages whose yarn ends have not been successfully preliminarily disposed by an initial yarn end readying process are recirculated to the yarn end readying devices for additional yarn end readying cycles. However, the recirculation of such yarn packages in this manner exposes these yarn packages to relatively high cumulative stresses due to the repeated handling of the yarn packages by the yarn end readying devices. Moreover, the mixing of such recirculating yarn packages with those yarn packages which have not yet been initially handled for yarn end preparation increases the average time of handling of those yarn packages whose yarn ends are initially successfully readied.

German Patentschrift 32 35 442 discloses an assembly in which a plurality of individual package support members travel in a closed loop between the spinning machine and the winding machine. A rotating platform member having a plurality of yarn package readying devices mounted about its circumference is provided for readying the yarn ends of yarn packages delivered to the winding machine. Those packages whose yarn ends are not initially successfully disposed in a preferred preliminary disposition following their initial circuit around the yarn end readying devices are re-circulated to the yarn end readying devices for another attempt to dispose their yarn ends in preferred preliminary dispositions. However, the mixing of those yarn packages being recirculated with fresh incoming yarn packages detrimentally increases the average handling time of those yarn packages whose yarn ends are successfully disposed in a preferred preliminary disposition following their initial circuit to the yarn end readying devices.

Accordingly, the need exists for an assembly for handling yarn packages delivered from a spinning machine to a winding machine to insure that the yarn ends of the yarn packages are efficiently disposed in preferred preliminary dispositions.

SUMMARY OF THE INVENTION

The present invention provides an assembly for improving the efficiency of the handling of yarn packages delivered from a spinning machine to a winding machine.

Briefly described, the present invention provides a yarn package assembly in a winding machine having a plurality of winding stations for winding yarn from yarn packages of the type formed from yarn built onto tubes, the tubes being supported by a plurality of package support members in upright dispositions. The assembly for handling yarn packages prepares the yarn packages for unwinding at the winding stations and prepares unwound tubes for transfer from the winding machine as empty tubes.

The assembly includes means for transporting package support members with yarn packages thereon along a supply travel path to the winding stations; and yarn end disposing means disposed along the supply travel path for disposing the yarn end of a yarn package in a preferred preliminary disposition for engagement at a winding station. Also, the assembly includes another yarn end disposing means for disposing the yarn end of a yarn package in a preferred preliminary disposition for engagement at a winding station, the transporting means transporting package support members from the another yarn end disposing means along another travel path:

According to one aspect of the present invention, the first-mentioned yarn end disposing means and the another yarn end disposing means have different operating characteristics for yarn end disposing. According to a further aspect of the present invention, the transporting means transports the package support members along the another travel path to the supply travel path.

In one of the forms of the assembly, the another yarn end disposing means is disposed for receiving yarn packages having yarn ends that were not properly disposed by the first-mentioned yarn end disposing means.

According to additional features of the assembly, at least one of the yarn end disposing means includes means for mechanically loosening a yarn end from a yarn package and means for applying a suction action substantially along the entire axial extent of a yarn package to engage a loosened yarn end thereon. The another yarn end disposing means includes a chamber positionable circumferentially about an upper axial portion of the yarn packages for applying a suction action thereto to effect loosening of a yarn end.

The one form of the assembly can additionally include the feature that the transporting means transports package support members from the winding stations along a discharge travel path and the another travel path extends from the discharge travel path to the supply travel path. According to further features of the one form of the assembly, there is provided sensing means for sensing the disposition of yarn ends of packages after travel through the first-mentioned yarn end disposing means, and means responsive to the sensing means for guiding to the another travel path those package support members having yarn packages with yarn ends that were not properly disposed by the first-mentioned yarn end disposing means.

The one form of the assembly can also include the feature of yarn amount sensing means located along the discharge travel path for sensing a predetermined minimum amount of yarn on a tube on a package support member traveling therepast, and package support member diverting means responsive to the yarn amount sensing means for diverting package support members supporting tubes having more than the predetermined minimum amount of yarn thereon from the discharge travel path to the another path.

According to yet another feature of the one form of the assembly, there is provided sensing means for sensing the disposition of yarn ends of packages after travel through the another yarn end disposing means, means responsive to the sensing means for guiding from the another travel path package support members having yarn packages with yarn ends that were not properly disposed by the another yarn end disposing means, and storage means for receiving and storing package support members guided from the another travel path by the guiding means.

According to another variation of the present invention, the supply travel path is a main supply travel path, the transporting means includes a plurality of intermediate supply travel paths for transport of package support members from the main supply travel path to the winding stations. Also, there is a plurality of the first-mentioned yarn end disposing means, each of the first-mentioned yarn end disposing means being disposed along a different one of the intermediate supply travel paths, and there is provided means for selectively guiding each package support member from the main supply travel path to a selected intermediate supply path.

According to yet another variation of the present invention, there is provided sensing means for sensing yarn packages on package support members on the supply travel path upstream of the first-mentioned yarn end disposing means for sensing a predetermined package condition and guiding means responsive to the sensing means to guide package support members from the supply travel path to the another yarn end disposing means.

According to a further additional aspect of the present invention, there is provided guiding means for selectively guiding package support members from the supply travel path upstream of the first-mentioned yarn end disposing means to the another yarn end disposing means to increase the utilization thereof.

In yet an additional aspect of the present invention, there is provided guiding means for guiding package support members having packages with yarn spun at the end of a yarn batch from the supply travel path upstream of the first-mentioned yarn end disposing means to the another yarn end disposing means to increase the utilization thereof.

The one form of the assembly can alternately include the further features of yarn amount sensing means located along the discharge travel path for sensing the presence of yarn on a tube on a package support member traveling therepast and package support member diverting means responsive to the yarn sensing means for diverting package support members supporting tubes with yarn thereon to the another travel path. Also, there is provided residual yarn sensing means located along the another travel path for sensing the presence of less than a predetermined amount of yarn on a tube supported by a package support member traveling therepast, and package support member diverting means responsive to the residual yarn sensing means for diverting package support members supporting tubes having residual yarn thereon less than a predetermined amount from the another travel path. Moreover, there can be provided tube stripper means for stripping yarn from tubes on package support members diverted by the residual yarn diverting means, the tube stripper means including means for transporting package support members through the tube stripping means and returning them to the discharge travel path.

According to one aspect of the further features of the one form of the assembly, the transporting means of the tube stripper means returns the transported package support members to the discharge travel path upstream of the yarn sensing means.

The features of the one form of the assembly can further include residual yarn sensing means located along the discharge travel path downstream of the yarn amount sensing responsive diverting means for sensing the presence of residual yarn on tubes on package support members traveling therepast, and package support member diverting means responsive to the residual yarn sensing means for diverting package support members supporting tubes having residual yarn thereon from the discharge path. Also, tube stripper means for stripping residual yarn from tubes on package support members diverted by the residual yarn diverting means can be provided.

According to another additional aspect of the one form of the assembly, the tube stripping means includes means for sensing tubes that have not been successfully stripped of yarn by the tube stripping means and means for storing package support members supporting unsuccessfully stripped tubes thereon without return to the discharge travel path.

DETAILED DESCRIPTION OF THE PREFERRED EMBODIMENTS

Figure 1:
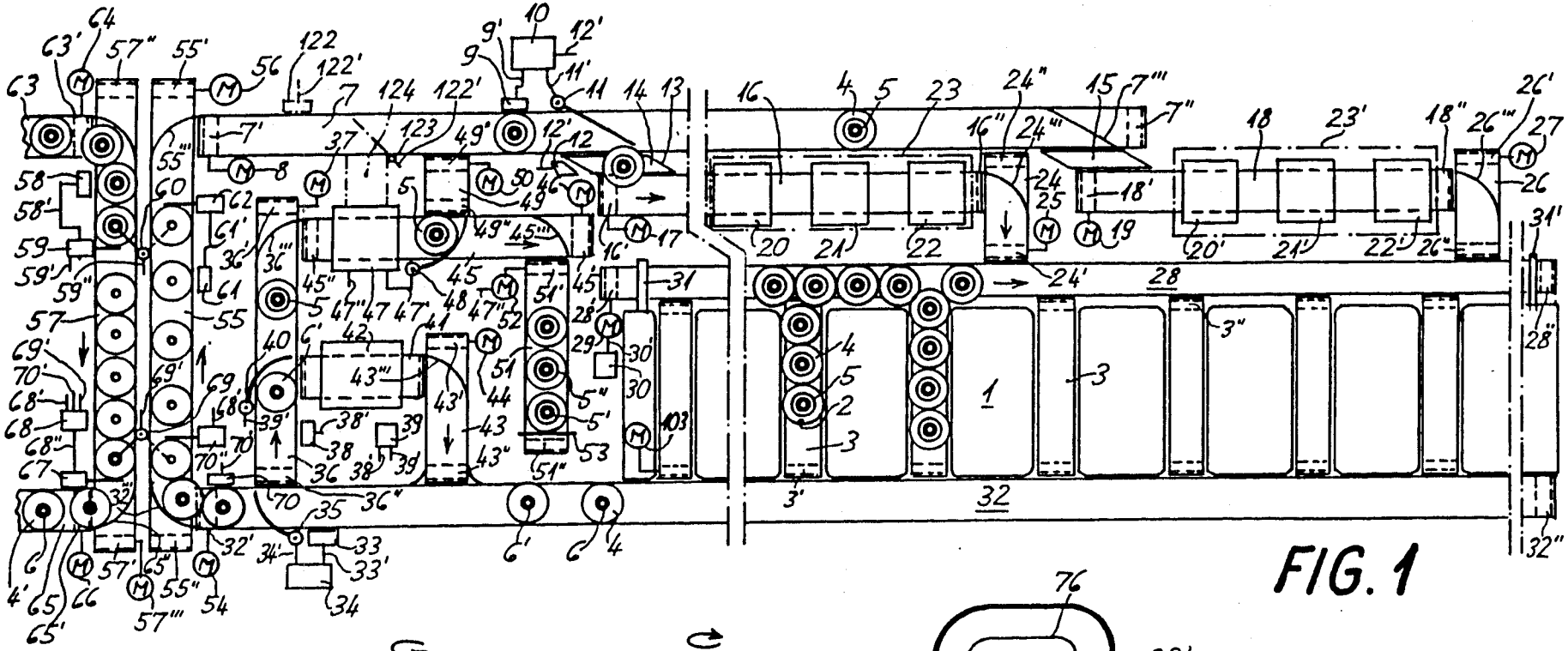
FIG. 1 is a plan view of a winding machine and a portion of a spinning machine operatively interconnected with the winding machine and showing the yarn package handling assembly of the present invention.

In FIG. 1, one embodiment of the yarn package handling assembly of the present invention is illustrated. A conventional winding machine 1 has a plurality of winding stations for individually winding yarn from yarn packages. The winding machine 1 is operatively interconnected with a conventional spinning machine, a portion of which is shown at the left in FIG. 1, in such a manner that the winding machine 1 is dedicated for the winding of yarn packages produced by the spinning stations of the spinning machine.

The spinning machine includes a transport assembly for transporting yarn packages which have been built on tubes 6 at its spinning stations to a transfer location for transfer to the winding machine 1. The spinning machine transport assembly includes a pair of conventional endless belts 63,65, each disposed along a respective side of the spinning machine and trained around a drive roller 63',65', respectively, for driving operation by a conventional drive motor 64,66, respectively. The endless belts 63,65 support a plurality of conventional peg tray-type package support members 4' on which the yarn packages built at the spinning stations are supported for transport to the transfer location for transfer of the yarn packages to the winding machine 1.

The endless belt 63 is a delivery belt operable to transport the peg trays 4' having full yarn packages supported thereon in a direction toward the transfer location while the endless belt 65 is a take-away belt operable to transport the peg trays 4' having empty tubes 6 supported thereon in the direction away from the winding machine 1 for re-supplying the spinning stations of the spinning machine with empty tubes. A conventional endless belt 57 extending along one end of the spinning machine transversely between the delivery and take-away belts 63, 65 is trained around a conventional guide roller 57'' and a drive roller 57'. The drive roller 57' is operatively connected to a conventional drive motor 57''' for driving operation of the transverse belt 57. The transport assembly of the spinning machine includes conventional means for operatively interconnecting the endless belts 63,65 with the transverse belt 57 for the smooth passage of the peg trays 4' from the delivery belt 63 to the transverse belt 57 and from the transverse belt 57 to the takeaway belt 65.

A conventional yarn package transfer device 60 is positioned adjacent the travel path of the transverse belt 57 at the transfer location for transferring full yarn packages supported on the peg trays 4' at the spinning machine onto a plurality of peg trays 4 on the winding machine 1. A conventional sensor 58 for sensing the presence of a yarn package arriving at the transfer location is operatively connected via a connector 58' with a peg tray stop member 59. The peg tray stop member 59 is operatively connected via a connector 59' with the yarn package transfer device 60 and is operable to selectively dispose an arm transversely to the direction of travel of the transverse belt 57 for preventing movement of a peg tray 4' beyond the transfer location. The peg tray stop member 59 is operated in coordination with the transfer operation of the yarn package transfer device 60 to stop the peg trays 4' at the transfer location for permitting the yarn package transfer device 60 to engage the full yarn packages supported on the peg trays 4' and transfer these full yarn packages to the peg trays 4 of the winding machine 1.

The winding machine 1 is provided with the yarn package handling assembly of the present invention for handling the yarn packages transferred to the winding machine to prepare the yarn ends thereof for engagement at the winding stations of the winding machine and for delivering empty tubes 6 from the winding stations to a location on the winding machine for transfer of the empty tubes to the peg trays 4' of the spinning machine. The yarn package handling assembly includes a first yarn package readying component for readying the yarn packages for unwinding engagement at the winding stations, a second yarn package readying component for readying selected yarn packages for engagement at the winding stations and means for transporting the selected yarn packages from the first yarn readying component to the second yarn readying component.

The yarn package handling assembly includes a conventional endless member or belt 55 at the end of the winding machine 1 adjacent an end of the spinning machine and extending generally parallel to the travel path of the transverse belt 57 of the spinning machine. This end belt 55 is trained around a conventional guide roller 55'' and a conventional drive roller 55', which is operatively connected to a conventional drive motor 56 for driving of the end belt 55 in an endless travel path. A conventional endless member or belt 7 extends as a main supply belt from a location adjacent the travel path of the end belt 55 along one longitudinal side of the winding machine 1 and is trained around a conventional guide roller 7'' and a conventional drive roller 7'. The drive roller 7' is operatively connected to a conventional drive motor 8 for driving of the main supply belt 7 in conventional manner in an endless travel path. An arcuately-shaped guide member 55''' extends across the juncture of the end belt 55 and supply belt 7 for guiding the travel of peg trays 4 from the end belt 55 to the main supply belt 7.

A sensor 9 is positioned adjacent the travel path of the main supply belt 7 and is operatively connected via a connector 9' to a control unit 10. A gate member 11 is operatively connected via a connector 11' to the control unit 10 and includes an arm selectively movable between a clearance position clear of the travel path of the peg trays 4 transported by the main supply belt 7 and a diverting position in which the arm extends at an angle across the travel path of the peg trays 4 for diverting the peg trays 4 from the main supply belt 7.

A conventional endless member or belt 16 extends as an intermediate supply belt parallel to the main supply belt 7 from a location downstream of the diverting location of the gate member 11. This intermediate supply belt 16 is trained around a conventional guide roller 16'' and a conventional drive roller 16', which is operatively connected to a conventional drive motor 17. The drive motor 17 and the drive roller 16' are operable to drive the intermediate supply belt 16 in the same direction as the direction of travel of the main supply belt 7. A support member 13 has a sliding surface 14 and extends from the main supply belt 7 adjacent the diverting location at which the gate member 11 diverts the peg trays 4 from the main supply belt 7 to a location adjacent the intermediate supply belt 16 for providing a support for sliding movement of the peg trays 4 therealong from the main supply belt 7 to the intermediate supply belt 16. A sensor 12 is disposed adjacent the support member 13 and is operatively connected via a connector 12' to the control unit 10. The sensor 12 senses the presence of a peg tray 4, or a package 6 supported thereon, at a predetermined location on the support member 13.

A plurality of yarn end disposing devices 20,21 and 22 are positioned in respectively further downstream positions along the travel path of the intermediate supply belt 16. An endless member 24 in the form of a transfer belt extends generally transversely to the direction of travel of the intermediate supply belt 16 adjacent the end thereof downstream from the yarn end disposing devices 20–22. This transfer belt 24 is trained around a conventional guide roller 24" and a conventional drive roller 24', which is operatively connected to a drive motor 25 for driving operation of the transfer belt 24. An arcuately-shaped guide member 24''' is positioned across the end of the travel path of the intermediate supply belt 16 for guiding transfer of the peg trays 4 from the intermediate supply belt 16 to the transfer belt 24.

An endless member 28 in the form of a final supply belt extends parallel to the belts 7,16 at a location intermediate the intermediate supply belt 16 and the winding stations of the winding machine 1. This final supply belt 28 is trained around a conventional guide roller 28" and a conventional drive roller 28', which is operatively connected to a drive motor 29. The drive motor 29 is operatively connected via a connector 30' to a control unit 30 for controlling the operation of the drive motor 29 to effect selective movement of the final supply belt 28 in opposite travel directions. The final supply belt 28 extends adjacent the downstream end of the transfer belt 24 to receive peg trays 4 transferred thereat. A plurality of endless members or belts 3 each extend through a respective winding station of the winding machine 1 and have an upstream end adjacent the final supply belt 28 for receiving peg trays 4 therefrom. The winding station belts 3 are each trained around a conventional guide roller 3" and a conventional drive roller 3', which is operatively connected to a conventional drive motor 103 for individual driving of the associated belt.

A second intermediate supply belt 18 extends parallel to the main supply belt 7 and generally in line with the first-mentioned intermediate supply belt 16. The second intermediate supply belt 18 is trained around a conventional guide roller 18" and a conventional drive roller 18', which is operatively connected to a conventional drive motor 19 for driving operation of the belt 18. The upstream end of the second intermediate supply belt 18 is disposed slightly upstream from the downstream end of the main supply belt 7 and a support member 15 having a sliding surface extends from the main supply belt 7 adjacent its downstream end to a position adjacent the upstream end of the second intermediate supply belt 18 for transfer of peg trays thereon. A guide member 7''' extends at an angle transversely across the travel path of the main supply belt 7 adjacent its downstream end for diverting the peg trays 4 from the main supply belt 7 onto the support member 15 for sliding movement of the peg trays 4 onto the second intermediate supply belt 18. A plurality of yarn end disposing devices 20',21',22' are disposed in respectively further downstream positions along the travel path of the second intermediate supply belt 18.

An endless member 26 in the form of a second transfer belt extends generally transversely to the direction of the second intermediate supply belt 18 adjacent the downstream end thereof downstream of the yarn end disposing devices 20', 21', 22'. This second transfer belt 26 is trained around a conventional guide roller 26" and a conventional drive roller 26', which is operatively connected to a conventional drive motor 27 for driving operation of the second transfer belt 26. An arcuately-shaped guide member 26''' is positioned beyond the end of the travel path of the second intermediate supply belt 18 for guiding transfer of peg trays 4 from the second intermediate supply belt 18 to the second transfer belt 26. The downstream end of the second transfer belt 26 is positioned adjacent the final supply belt 28 for movement of the peg trays 4 onto the final supply belt 28.

An endless member 32 in the form of a discharge belt extends along the other longitudinal side of the winding machine 1 parallel to the travel path of the main supply belt 7 and is trained around a conventional guide roller 32" and a conventional drive roller 32', which is operatively connected to a conventional drive motor 54. The downstream end of each winding station belt is positioned adjacent the travel path of the discharge belt 32 for effecting transfer of the peg trays 4 from the winding stations to the discharge belt 32. A sensor 33 for sensing the presence of a predetermined minimum amount of yarn on a tube traveling therepast is positioned adjacent the discharge belt 32 downstream from the winding stations and is operatively connected via a connector 33' to a control unit 34. An arcuate gate member 35 is positioned downstream of the sensor 33 and is operatively connected via a connector 34' to the control unit 34 for selective controlled movement of the gate member 35 from a clearance position clear of the travel path of the discharge belt 32 to a peg tray diverting position extending transversely across the discharge belt 32.

Another travel path, designated as a first return path, is formed by an endless member in the form of a return belt 36 extending in a travel path transverse to the discharge belt 32 and trained around a conventional guide roller 36" and a conventional drive roller 36', which is operatively connected to a conventional drive motor 37. The drive motor 37 is operable to drive the return belt 36 in a direction away from the discharge belt 32. An endless member or belt 41 extends transversely from the return belt 36 and is trained around a conventional guide roller and a conventional drive roller, which is operatively connected to a conventional drive motor for driving of the belt 41 from the return belt 36 in a cooperative disposition therewith for receiving peg trays 4 transferred therefrom. A gate member 40 is positioned adjacent the return belt 36 and includes an arm movable from a clearance position clear of the travel path of the return belt 36 to a peg tray diverting position transversely across the travel path of the return belt 36 for guiding peg trays 4 there onto the endless belt 41. The gate member 40 is connected by a connector 39' to a control unit 39. A tube stripping sensor 38 is positioned adjacent the travel path of the return belt 36 upstream of the gate member 40 and is operatively connected to the control unit 39 by a connector 38'. The sensor 38 senses the presence of a predetermined minimum amount of yarn on tubes traveling therepast.

A conventional yarn tube stripping device 42 is disposed in the travel path of the belt 41 for handling the tubes 6' supported on peg trays 4 which are transported along this tube stripper belt 41.

An endless member or belt 43 extends transversely from the downstream end of the tube stripper belt 41 and is trained around a conventional guide roller 43'' and a conventional drive roller 43', which is operatively connected to a conventional drive motor 44 for driving operation of the endless member 43. The downstream end of the endless, member 43 is disposed at the discharge belt 32 in cooperative disposition therewith for transferring peg trays 4 from the belt 43 to the discharge belt 32. An arcuately-shaped guide member 43''' extends across the travel path of the belt 43 at the downstream end of the tube stripper belt 41 for guiding peg trays 4 onto the belt 43.

Another endless member, or belt 45 is trained around a conventional guide roller 45'' and a conventional drive roller 45', which is operatively connected to a conventional drive motor 46 for driving operation thereof. The upstream end of this belt 45 is positioned adjacent the end of the return belt 36 at a location further downstream from the tube stripper belt 41 for receiving peg trays 4 transferred from the return belt 36. An arcuately-shaped guide member 36''' extends transversely across the travel path of the return belt 36 at the location of the upstream end of the belt 45 for guiding movement of peg trays 4 moved from the return belt 36 onto the belt 45.

Another yarn end disposing means in the form of an auxiliary yarn end disposing device 47 is disposed along the travel path of the belt 45 and is operatively connected via a connector 47' to a gate member 48. The gate member 48 is disposed further downstream than the auxiliary yarn end disposing device 47 and includes an arm movable from a clearance position clear of the travel path of the belt 45 to a peg tray diverting position transversely across the travel path of the belt 45 for guiding movement of peg trays from the belt 45 onto another endless member or belt 49 that is trained around a conventional guide roller 49'' and a conventional drive roller 49', operatively connected to a conventional drive motor 50 for driving operation of the belt 49. The upstream end of this belt 49 is disposed adjacent the belt 45 in cooperative disposition therewith for receiving peg trays transferred therefrom by the diverting action of the gate member 48. The downstream end of this belt 49 is positioned adjacent the main supply belt 7 in cooperative disposition therewith for transfer of peg trays from the belt 49 to the main supply belt 7.

An arcuately-shaped guide member 45''' extends transversely across the travel path of the belt 45 that travels through the auxiliary yarn end disposing device 47 at a location further downstream than the gate member 48. The arcuately-shaped guide member 45''' guides peg trays from the end of the belt 45 onto an endless member 51 in the form of a second storage belt that is trained around a conventional guide roller 51'' and a conventional drive roller 51', operatively connected to a conventional drive motor 52 for driving operation of the second storage belt 51. A peg tray stop member 53 extends transversely across the travel path of the second storage belt 51 for preventing further downstream travel of peg trays and thereby causing peg trays to be stored thereon. The drive motor 52 of the second storage belt 51 is operatively connected via a connector 47'' to the auxiliary yarn end disposing device 47.

A bypass path from the main supply belt 7 to the auxiliary yarn end disposing device 47 may be provided as indicated in dot-dash lines in FIG. 1. This bypass path includes a support member 124 for supporting peg trays for sliding movement from the main supply belt to the auxiliary yarn end disposing device 47. A gate member 123 is disposed adjacent the junction cf the main supply belt 7 and the support member 124 and includes an arm movable between a clearance position clear of the travel path of the main supply belt 7 and a peg tray diverting position transversely across the travel path for guiding peg trays 4 from the main supply belt 7 onto the support member 124 for sliding movement therealong to the auxiliary yarn end disposing device 47.

The downstream end of the discharge belt 32 is disposed adjacent the upstream end of the end belt 55 in cooperative disposition therewith for transferring peg trays 4 from the discharge belt 32 onto the belt 55. For this purpose an arcuately-shaped guide member 32''' extends transversely across the travel paths of the belts. A sensor 70 is disposed adjacent the downstream end of the discharge belt 32 and is operatively connected via a connector 70' to a control unit 68. A peg tray stop member 70'' is positioned adjacent the end belt 55 downstream of the arcuately-shaped guide member 32''' and includes a stop member movable between a clearance position clear of the travel path of the belt 55 for permitting travel therepast of peg trays 4 and a peg tray stop position transversely across the travel path of the end belt 55 for preventing further downstream travel of peg trays 4. The peg tray stop member 70'' is operatively connected via a connector 68' to the control unit 68.

An empty tube transfer device 69 is positioned intermediate the end belt 55 and the transverse belt 57 adjacent the operating location of the peg tray stop member 70'' for transferring the empty tubes supported on the peg trays 4 on the end belt 55 to the empty peg trays 4 disposed on the transverse belt 57. The empty tube transfer device 69 is operatively connected via a connector 69' to the control unit 68.

A peg tray stop member 67 is disposed adjacent the transverse belt 57 and is operatively connected via a connector 68'' to the control unit 68. The peg tray stop member 67 includes an arm movable from a clearance position clear of the travel path of the transverse belt 57 for permitting peg trays 4' to travel therepast and a peg tray stopping position transversely across the travel path of the transverse belt 57 for preventing further downstream movement of the peg trays 4'. An arcuately-shaped guide member 65'' extends transversely across the downstream end of the transverse belt 57 and extends to the upstream end of the take-away belt 65 for guiding movement of empty peg trays 4' from the transverse belt 57 to the take-away belt 65 to the spinning stations.

A pair of peg tray travel limit members 31,31' extend transversely across the travel path of the final supply belt 28 and each is positioned beyond a respective one of the opposite endmost winding station belts 3. The peg tray travel limit members 31,31' limit the movement of the peg trays 4 supported on the final supply belt 28 to the extent of the travel path between the two limit members.

The integrated operation of the spinning machine and the winding machine 1, including the operation of the yarn package handling assembly of the present invention, will now be described. Experience has demonstrated that, on average, a certain percentage of each batch of full yarn packages handled in an integrated spinning machine/winding machine operation will be successfully handled in an initial yarn end disposing operation and that, in fact, this percentage of yarn package comprises the majority of the yarn packages of any given spinning machine batch. The balance of the yarn packages whose yarn ends are not initially successfully disposed in a preferred preliminary disposition must be subjected to further handling to prepare these yarn packages for unwinding by the winding stations of the winding machine. The yarn package handling assembly of the present invention beneficially exploits the operational reality that the yarn ends of the majority of the yarn packages are initially successfully disposed in a preferred preliminary disposition by providing a first yarn package readying component which handles all of the full yarn packages delivered to the winding machine 1 and a second yarn package readying component dedicated only for handling those yarn packages whose yarn ends were not successfully disposed in a preferred preliminary disposition by the first yarn package readying component. This arrangement permits, on average, the majority of the yarn packages (i.e., those packages whose yarn ends are initially successfully disposed in a preferred preliminary disposition) to be directly transported from the yarn end disposing devices to the assembly for feeding the yarn packages to the individual winding stations without subjecting these yarn packages to the delays which inherently occur when these initially successfully handled yarn packages are mixed with the initially unsuccessfully handled yarn packages. Moreover, since, on average, the yarn packages whose yarn ends are not initially successfully disposed in a preliminary preferred position comprise only a minority of the yarn packages of any given batch, the subsequent handling of these yarn packages can be conducted at a relatively much slower pace without significantly interfering with the overall efficiency of the winding operation. The relatively slower pace of handling of these yarn packages permits relatively more thorough handling of the packages, thus leading to consequent increases in the probability that such yarn packages will have their yarn ends successfully disposed in a preferred preliminary disposition during the subsequent handling thereof.

The operation of the first yarn package readying component of the yarn package handling assembly will initially be described to illustrate the handling of the majority of the yarn packages—i.e., those yarn packages whose yarn ends are initially successfully disposed in a preferred preliminary disposition. A batch of full yarn packages, which have previously been transferred in conventional manner from the spinning stations of the spinning machine onto the pegs of the peg trays 4' for support thereon during transport of the peg trays, is conveyed by movement of the peg trays 4' by the delivery belt 63 to its downstream end for transfer to the transverse belt 57. The oncoming peg trays 4' with full yarn packages supported thereon, are transferred automatically from the delivery belt 63 onto the transverse belt 57 and are guided into proper supported alignment thereon by a conventional arcuately-shaped guide member disposed transversely across the travel path of the delivery belt 57 at the transfer location. The sensor 58 senses the arrival of the oncoming peg trays 4' and signals the peg tray stop member via the connector 58' to cyclicly stop the peg trays 4' at the transfer location for transfer of a full yarn package from each peg tray 4' by the package transfer device 60. The package transfer device 60 transfers the full yarn package, which is supported on the respective peg tray 4' in engagement with the stop arm of the peg tray stop member 59, to an empty tray 4 supported on the end belt 55 of the winding machine 1. The control unit 61 controls the operation of the peg tray stop member 62 in coordination with the operation of the package transfer device 60 and the peg tray stop member 59 to cyclicly stop an empty peg tray 4 at the transfer location on the end belt 55 and to release the stopped peg tray once a full yarn package has been transferred thereto in coordination with the stopping and releasing of the peg trays 4' by the peg tray stop member 59. In this manner, the full yarn packages are cyclicly transferred in one-to-one correspondence from the peg trays 4' of the spinning machine to the peg trays 4 of the winding machine.

Following its release from the peg tray stop member 62, each peg tray 4 with a just-transferred full yarn package supported thereon, travels further along the travel path of the end belt 55 and is guided by the arcuately-shaped guide member 55''' from the end belt 55 onto the upstream end of the main supply belt 7 for transport thereby.

As each peg tray 4 with a full yarn package supported thereon is transported by the main supply belt 7 past the sensor 9, the sensor 9 signals the control unit 10 via the connector 9' concerning the movement therepast of the peg tray 4. The control unit 10 evaluates the sensed information received from the sensor 9 in correspondence with sensed information from the sensor 12 concerning the presence or absence of a peg tray 4 on the support member 14. If the signal from the sensor 12 indicates that a peg tray 4 is disposed on the support member 14, the control unit 10 evaluates this information as an indication that the intermediate supply belt 16 is currently filled with an amount of peg trays 4 sufficient to momentarily prevent the acceptance of the next peg tray 4 disposed on the support member 14. In this situation, the control unit 10 controls the gate member 11 to move to its clearance position to thereby permit the peg trays supported on the main supply belt 7 to travel downstream past the support member 14 for feeding onto the second intermediate supply belt 18.

The control unit 10 can alternatively be configured to control the operation of the gate member 11 to effect alternating feed of the oncoming peg trays 4 onto the support member 14 or further travel past the support member 14 for feeding onto the second intermediate supply belt 18. The angled guide member 7''' guides each oncoming peg tray 4 onto the support member 15 for sliding movement thereacross onto the second intermediate supply member 18.

Figure 4:
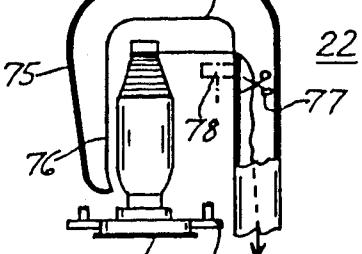
FIG. 4 is a front elevational view of a further type of yarn end disposing device of the yarn package handling assembly shown in FIG. 1.
Figure 3:
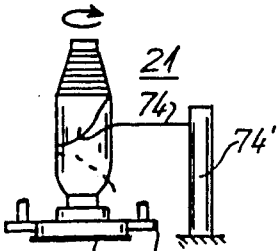
FIG. 3 is a front elevational view of another type of yarn end disposing device of the yarn package handling assembly shown in FIG. 1.
Figure 2:
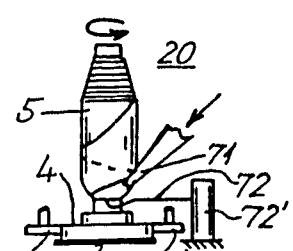
FIG. 2 is a front elevational view of one type of yarn end disposing device of the yarn package handling assembly shown in FIG. 1.

The yarn end disposing devices 20–22 and 20' to 22', which are disposed on the intermediate supply belts 16,18 can be configured in one of a variety of configurations for disposing the yarn end of yarn packages in preferred preliminary dispositions. The two groups of yarn end disposing devices 20–22 and 20'–22' are merely illustrative of the types of yarn end disposing devices which can be arranged for handling the full yarn packages to dispose their yarn ends in preferred preliminary dispositions. FIGS. 2–4 illustrate the series of configurations of the first group. As seen in FIG. 2, the upstream yarn end disposing device 20 preferably includes three rotating disk members 73 (only two of which are illustrated) cooperatively disposed relative to one another for selectively retaining and releasing a peg tray 4 at a yarn end disposing location. A mechanical yarn end loosener such as, for example, a relatively rigid stripping arm 72, is supported by a post 72' for pivoting into engagement with a full yarn package 5 supported on a peg tray 4 which is retained by the rotating disk members 73 at the yarn end disposing location. A conventional forced air jet device 71 has its mouth positioned adjacent the lower end of the full yarn package 5 for jetting air on the yarn package to facilitate loosening of a yarn end thereof in conjunction with the operation of the stripping arm 72. The rotating disk members 73 are cooperatively rotated in engagement with the circumferential periphery of the peg tray 4 to effect rotation of the full yarn package 5 in an unwinding direction during engagement of the yarn package by the stripping arm 72.

After its handling by the first yarn end disposing device 20,20' the yarn package 5 and the peg tray 4 on which it is supported are released for further movement by the intermediate supply belts 16, 18 to the second yarn end disposing device 21,21'. As shown in FIG. 3, each second yarn end disposing device 21,21' preferably includes three rotating disk members 73' (only two of which are illustrated) and a mechanical yarn end loosening device such as, for example, a stripper arm 74 supported for pivoting at a selected axial height relative to the yarn package 5 by a post 74'. The rotating disk members 73' are cooperatively rotated in engagement with the circumferential periphery of the peg tray 4 to effect rotation of the yarn package 5 in an unwinding direction while the stripper arm 74 engages the yarn package. The arm 74 momentarily engages the yarn end to loosen the yarn end in preparation for the next yarn end handling step. Following the loosening of the yarn end by the stripping arm 74, the rotating disk members 73' are moved out of interference with the peg tray 4 to permit the intermediate supply belt 16,18 to further transport the peg tray to the third yarn end disposing device 22,22'.

As seen in FIG. 4, the third yarn end disposing devices 22,22' preferably include three rotating disk members 73'' (only two of which are illustrated) and a conventional yarn end suction device 75 having a slot 76 therein for applying a suction axially along the yarn package 5 to engage the previously loosened yarn end thereof. The yarn end suction device 75 additionally includes a conventional yarn end cutting device 77 and a conventional sensor 78 for controlling the cutting action of the yarn end cutting device 77. After the peg tray 4 has been engaged by the rotating disk members 73'' to retain the peg tray at a yarn end disposing location, the yarn end suction device 75 is operated to draw the loosened yarn end into its slot 76 and downwardly past the cutting device 77. The sensor 78 senses the presence of the yarn end and controls the operation of the yarn end cutting device 77 to cut the yarn end. Thereafter, the rotating disk members 73'' are operated to rotate the yarn package 5 in the winding direction to wind the now-cut yarn end onto the yarn package. The yarn end is now disposed in a preferred preliminary disposition for ready engagement at one of the winding stations 24 to initiate winding of the yarn package 5.

Each yarn package 5 is accordingly subjected to the progressive yarn end handling steps performed by either of the three yarn end disposing devices 20–22 disposed along the first intermediate supply belt 16 or the three yarn end disposing devices 20'–22' disposed along the second intermediate supply belts 18. The majority of the yarn packages, on average, will have their yarn ends successfully disposed in a preferred preliminary disposition upon completion of these yarn end handling steps. Each peg tray 4 is subsequently guided by the arcuately-shaped guide member 24''',26''' from the intermediate supply belts 16,18 onto the transfer belts 24,26 for travel onto the final supply belt 28.

The final supply belt 28 is operated in cyclicly reversing manner to feed the peg trays 4 to the winding stations belts 3. The control unit 30 controls the drive motor 29 to cyclicly reverse the direction of travel of the final supply belt 28 in this feeding operation and the peg tray travel limit members 31 constrain the peg trays 4 to travel within a preset extent of the travel path of the final supply belt 28.

The final supply belt 28 has a lateral extent transverse to its endless extent smaller than the diameter of the peg trays 4 so that the peg trays 4 overlap and are engaged by the upstream ends of the winding station belts 3 as they are transported on the final supply belt 28 for feeding to the winding stations 2 for unwinding of the yarn packages 5 thereat. This operation and the cyclic reversing operation of the final supply belt 28 assures that the peg trays 4 are fed in a generally equal distribution to all of the winding stations.

As the peg trays 4 are fed from the final supply belt 28 to the winding station belts 3, the final supply belt 28 is able to accept further peg trays 4 fed to it from the transfer belts 24, 26. Thus, the feed of the peg trays 4 having yarn packages 5 supported thereon with their yarn ends in preferred preliminary dispositions occurs continuously and is limited only by the capacity of the yarn end disposing devices 20–22 and 20'–22' to perform the yarn end handling steps.

The present invention contemplates that other arrangements of conventional yarn end disposing devices can be used with equal effect in lieu of the yarn end disposing devices 20–22 and 20'–22' for disposing the yarn end of the yarn packages 5 in preferred preliminary dispositions.

The present invention also contemplates that the sensor 9 can be configured as a conventional color sensor for sensing appropriate conventional color identification means secured to either the peg trays 4 or the yarn packages 5 corresponding to the particular spinning machine batch in which the yarn package was produced. In this configuration, the control unit 10 would control the operation of the gate member 11 to position the gate member 11 in its peg tray diverting position transversely across the travel path of the main supply belt 7 for guiding the yarn packages of one of the batches onto the support member 14 for sliding movement therealong to the first intermediate supply belt 16 and to position the gate member 11 in its clearance position out of interference with the travel path of the main supply belt 7 to permit transport of the yarn packages of another batch by the main supply belt 7 beyond the support member 14 for eventual passage of the peg trays via the support member 15 to the second intermediate supply belt 18. Thus, the yarn end disposing devices 20–22 would handle the yarn end processing of only those yarn packages of the one batch while the second series of yarn end disposing devices 20'–22' would handle the yarn end processing of only those yarn packages of the other batch. It is further possible to configure the feeding arrangement of the yarn packages to the winding stations 2 such that certain dedicated winding stations 2 unwind only those yarn packages of the first batch while other dedicated winding stations 2 unwind only those yarn packages of the other batch. This can be accomplished, for example, by disposing a separating member transversely across the travel path of the final supply belt 28 intermediate its ends to restrict yarn packages of the two batches to separate winding stations.

All of the peg trays 4, including those peg trays 6 which support empty tubes (e.g., the tubes of those yarn packages which have been completely unwound at the winding stations 2) and those peg trays 6' supporting tubes still having yarn thereon (e.g., the tubes of those yarn packages which were incompletely unwound or not unwound at all at the winding stations 2) are discharged from the downstream ends of the winding stations 3 onto the discharge belt 32, which transports the peg trays 4 past the sensor 33 which senses the presence of a predetermined minimum amount of yarn on the tubes supported on the peg trays and signals this information via the connector 33' to the control unit 34. For example, the sensor 33 can be configured to sense the presence of any yarn on a tube so that the control unit 34 can cause the diverting of all tubes having any yarn thereon from the discharge belt 32. In this circumstance, the sensor 33 senses the presence of yarn on a tube, the control unit 34 activates the gate member 35 to move from its clearance position to its peg tray diverting position to guide the peg tray 4 supporting the respective tube onto the return belt 36. Accordingly, the tubes having a relatively small amount of remaining yarn, designated as 6', and the tubes still supporting incompletely unwound yarn packages, designated as 5, are diverted by the gate member 35 onto the return belt 36. On the other hand, if the sensor 33 senses that there is no yarn on a tube, the control unit 34 controls the gate member 35 to remain in its clearance position to permit the peg tray supporting the respective tube to travel downstream past the gate member 35. As the diverted tubes are transported on the return belt 36 past the sensor 38, the sensor 38 senses whether the amount of yarn on the tubes exceeds a predetermined minimum amount of yarn corresponding to the minimum yarn amount deemed worthwhile for recirculating to the winding stations 2 for a further package winding attempt and signals this information to the control unit 39 via the connector 38'. If the sensor 38 detects that the amount of yarn on a tube passing thereby is less than the predetermined minimum amount (i.e.—a tube 6'), the control unit 38 controls the gate member 40 to move from its clearance position to its peg tray diverting position to guide the peg tray supporting the respective tube 6' from the return belt 36 onto the belt 41. On the other hand, if the sensor 38 senses that the amount of yarn on a tube passing thereby exceeds the predetermined minimum amount (i.e.—a tube 5), the control unit 39 controls the gate member 40 to remain in its clearance position to permit further transport of the peg tray supporting the respective tube 5 past the gate member 40.

Those peg trays supporting the tube 6' having only a relatively insignificant amount of yarn thereon are transported by the belt 41 to the tube stripping device 42 for stripping of the yarn from the tube 6' thereby. The peg trays 4 exiting the tube stripping device 42 thus support only empty tubes and these peg trays are guided by the arcuately-shaped guide member 43''' from the downstream end of the belt 41 onto the belt 43 and travel onto the discharge belt 32 for travel past the sensor 33, which now detects that the peg trays support empty tubes. The control unit 34 accordingly controls the gate member 35 to remain in its clearance position to permit these peg trays supporting empty tubes to travel therepast.

Those yarn packages exiting the tube stripping device 42 which have not been successfully stripped of yarn by the yarn stripping device are recirculated again from the discharge belt 32 in the same manner described above. In this situation, the sensor 33 senses the presence of yarn on these tubes as they pass by and the control unit 34 controls the gate member 35 to move to its peg tray diverting position to recirculate these yarn packages to the yarn stripping device 42 for another yarn stripping cycle.

Those peg trays supporting more than the minimum amount of yarn on their tubes 5 which have traveled past the gate member 40 along the travel path of the return belt 36 are eventually guided by the arcuately-shaped guide member 36''' from the return belt 36 onto the belt 45. The tubes supported on these peg trays include both those tubes supporting yarn packages, designated as 5', having yarn ends which could not be successfully engaged by the winding stations 2, and those packages, designated as 5'', having yarn ends which were not successfully disposed in preferred preliminary dispositions by the yarn end disposing devices 20–22 and 20'–22'. The packages 5' also include those yarn packages which may have had their yarn ends successfully disposed in preferred preliminary dispositions and which were only partially unwound at the winding stations 2. These type of yarn packages are likely to be of the type which can be successfully completely unwound upon subsequent recirculation to the winding stations 2.

Figure 6:
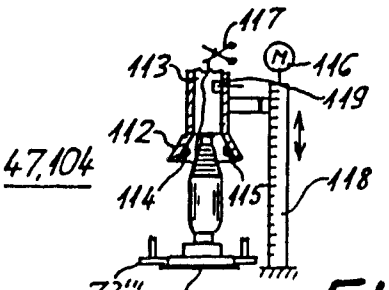
FIG. 6 is a front elevational view of one type of yarn end disposing device of the yarn package handling assembly shown in FIG. 5.

Those recirculating peg trays 4 supporting the yarn packages 5' or 5'' are transported by the belt 45 to the aforementioned auxiliary yarn end disposing device 47. As seen in FIG. 6, this auxiliary yarn end disposing device 47 includes a plurality of rotating disk members 73''' supported on a conventional position changing device such as, for example, a solenoid assembly or a motor driven pivot arm for selectively moving the disk members from clearance positions clear of the travel of the peg trays along belt 45 and peg tray retaining positions in one peg tray travel path to selectively retain and release peg trays at a yarn end disposing location relative to the auxiliary yarn end disposing device 47. Additionally, this auxiliary yarn end disposing device 47 includes a suction chamber 113 having a bell-shaped bottom portion 112. A light source 114 and a conventional photoelectric cell 115 are disposed in the bell-shaped portion 112. A conventional yarn end cutting device 117 is disposed in the suction chamber 113 upstream from the bell-shaped portion 112 relative to the direction of suction applied through the suction chamber. A sensor 119 is disposed downstream adjacent the yarn end cutting device 117. The suction chamber 113 is movably mounted on a post 118 for selective adjustable positioning therealong. A drive motor 116 is operable to selectively adjustably position the suction chamber 113 relative to the post 118.

In operation, the rotating disk members 73''' are moved into engagement with a peg tray 4 transported to the auxiliary yarn end disposing device 47 by the belt 45 to retain the peg tray at a yarn end disposing location. The motor 116 is operated to lower the suction chamber 113 into yarn end engaging disposition in which the bell-shaped portion 112 is disposed over a top portion of the yarn package supported on the peg tray 4. The rotating disk members 73''' are rotated in correspondence with one another in engagement with the circumferential periphery of the peg tray 4 to rotate the supported yarn package in an unwinding direction while suction is applied to the yarn package through the suction chamber 113. The lowering of the suction chamber 113 over the top of the yarn package is controlled through sensing by the photoelectric cell 115 of an interruption of the transmission of light from the light source 114 as the yarn package moves between the photoelectric cell 115 and the light source 114. The sensor 119 senses the presence of the yarn end in the suction chamber 113 and controls the operation of the yarn end cutting device 117 to cut the yarn end. Thereafter, the rotating disk members 73''' are rotated to effect rotation of the yarn package in a winding direction to wind the now-cut yarn end onto its preferred preliminary disposition on the yarn package.

The sensor 119 is preferably operatively connected to the gate member 48 to transmit a signal thereto indicating that a yarn end has successfully been suctioned into the suction chamber 113. In this event, the gate member 48 is controlled to move from its clearance position to its peg tray diverting position to divert the peg tray supporting the yarn package which has just had its yarn end disposed in a preferred preliminary disposition onto the belt 49 for transport thereby to the main supply belt 7. These yarn packages are then transported by the main supply belt 7 and, eventually, by the pair of intermediate supply belts 16, 18 to the final supply belt 28 for feeding to the winding stations 2. The auxiliary yarn end disposing device 47 can be configured to merely loosen the yarn end of a package, rather than disposing the yarn end in a preferred preliminary disposition, and the yarn end disposing devices 20–22 or 20'–22' can thereafter engage the loosened yarn end to dispose it in a preferred preliminary disposition.

Those yarn packages 5', 5'' whose yarn ends are not successfully handled by the auxiliary yarn end disposing device 47 are transported further by the belt 45 past the gate member 48. In this situation, the sensor 119 can signal the gate member 48 to remain in its clearance position in response to the sensing by the sensor 119 that a yarn end has not been suctioned into the suction chamber 113. The peg trays supporting these yarn packages are guided by the arcuately shaped guide member 45''' from the belt 45 onto the second storage belt 51, which acts as a collection location for supporting those peg trays 4 having yarn packages 5', 5'' whose yarn ends have not been successfully disposed in a preferred preliminary disposition at the auxiliary yarn end disposing device 47. The second storage belt 51 can be continuously operated since the stop member 53 prevents further downstream travel of the peg trays 4. The yarn packages 5', 5'' can thereby be collected for subsequent manual removal and handling by an operator.

Each of the peg trays 4 exiting from the winding stations 2 is accordingly transported from the winding station 2 to one of several post-winding handling operations: 1) to the end belt 55 for eventual transfer of its empty tube to the spinning machine; 2) to the tube stripping device 42 for stripping of yarn from the tube supported thereon and thereafter transported by the discharge belt 32 to the end belt 55; 3) to the auxiliary yarn end disposing device 47 for disposition of the yarn end of the package supported on the peg tray in a preferred preliminary disposition and thereafter to the main supply belt 7; or 4) to the second storage belt 51 for manual handling. The peg trays 4 supporting empty tubes travel past the sensor 33 on the discharge belt 32 and are transferred therefrom to the end belt 55, on which they are sequentially stopped at an empty tube transfer location by the peg tray stop member 70'', which is operated in conjunction with the operation of the empty tube transfer device 69 and the peg tray stop member 67. For this purpose, immediately before exiting the discharge belt 32 onto the belt 55, the peg trays 4 are sensed by the sensor 70 which signals the control unit 68 via the connector 70'. The control unit 68 responds to the signal from the sensor 70 by controlling the peg tray stop member 70'' to extend transversely across the end belt 55 to retain the oncoming peg trays 4 at the empty tube transfer location. The control unit 68 additionally controls the tube transfer device 69 to transfer empty tubes from the retained peg tray retained at the empty tube transfer location on the end belt 55 to an empty peg tray 4' retained at a spinning machine empty tube transfer location on the transverse belt 57 by the peg tray stop member 67.

Once the empty tube transfer device 69 has transferred an empty tube to the respective peg tray 4' of the spinning machine, the control unit 68 controls the peg tray stop member 67 to permit travel therepast of the respective peg tray 4'. These spinning machine peg trays 4' with empty tubes loaded thereon are thereafter guided by the arcuately shaped guide member 65' onto the take-away belt 65 for transport to the spinning stations of the spinning machine for winding of yarn thereon in the spinning process.

In one modification of the embodiment of the yarn package handling assembly illustrated with respect to FIGS. 1–4 an optional support member 124 and gate member 123 can be operated in conjunction with a sensor 122 positioned adjacent the main supply belt 7 upstream of the gate member 123 and operatively connected thereto by a connector 122'. The sensor 122 can be configured to sense those yarn packages 5 traveling therepast having predetermined package conditions such as, for example, those yarn packages produced during the last production run of a batch. This type of yarn package typically is not successfully handled by yarn end disposing devices of the type having chambers which surround the axial extent of the yarn package during loosening of the yarn end therefrom. Instead, this type of yarn package is typically more successfully handled by yarn end disposing devices of the type such as the auxiliary yarn end disposing device 47 described with respect to FIG. 6. Accordingly, the sensor 122 can be configured to sense the passage thereby of this type of yarn packages and to signal the gate member 123 to move to its peg tray diverting position transversely across the travel path of the main supply belt 7 to divert the peg trays supporting this type of yarn packages for travel along the support member 124 directly to the auxiliary yarn end disposing device 47. To increase the utilization of the auxiliary yarn end disposing device 47, the yarn package handling assembly can include a switch device (not shown) for controlling the operation of the gate member 12 to insure that the auxiliary yarn end disposing device 47 is continuously supplied with yarn packages. In this regard, the control of the operation of the gate member 123 can be controlled in correspondence with the completion of a batch at the spinning station.

Figure 5:
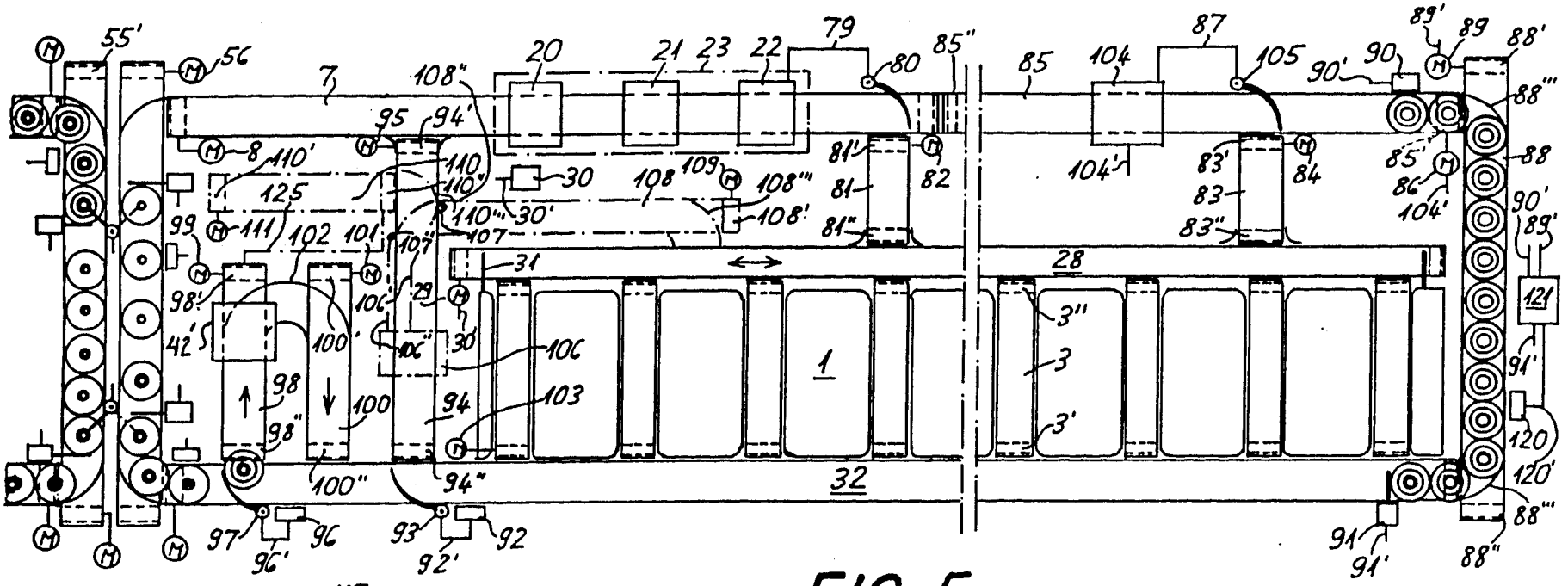
FIG. 5 is a plan view of a winding machine and a portion of a spinning machine operatively interconnected with a winding machine and showing another embodiment of the yarn package handling assembly of the present invention.

In FIG. 5, another embodiment of the yarn package handling assembly of the present invention is illustrated. A conventional winding machine 1, as described in the embodiment relating to FIGS. 1–4, includes a plurality of winding stations each having a belt 3 extending therethrough for the support of peg trays at the winding stations. Each winding station belt 3 is trained around a conventional guide roller 3″ and a conventional drive roller 3′, which is operatively connected to a motor 103 for driving operation of the belts. A final supply belt 28 identical in structure and operation to the final supply belt 28 of the embodiment discussed with respect to FIGS. 1–4, is operable to feed peg trays to the winding stations belts 3 in the same manner as described above.

A conventional spinning machine, a portion of which is shown in FIG. 5, is operatively interconnected with the winding machine 1 for building full yarn packages for unwinding of these yarn packages at the winding station 2 of the winding machine 1. The spinning machine includes a transport assembly for transport of peg trays having full yarn packages supported in upright dispositions thereon to a transfer location for transfer of the full yarn packages to empty peg trays on the winding machine 1.

This peg tray transport assembly of the spinning machine is identical to the peg tray transport assembly of the spinning machine discussed in the embodiment relating to FIGS. 1–4. The winding machine 1 includes an end belt identical in structure and operation to the end belt 55 for transporting peg trays from the location at which full yarn packages are transferred thereto to a junction with a main supply belt 7 for transfer of the peg trays thereto. The main supply belt 7 is trained around a conventional guide roller and a conventional drive roller, which is operatively connected to a motor 8 for driving operation thereof. The main supply belt 7 extends along one longitudinal side of the winding machine 1. A group 23 of yarn end disposing devices 20–22, which are identical in structure and operation to the yarn end disposing devices 20–22 of the embodiment shown in FIGS. 1–4, is disposed along the travel path of the main supply belt 7 for handling of full yarn packages supported on peg trays transported by the main supply belt 7. The last yarn end disposing device 22 is operatively connected via a connector 79 to a gate member 80, which has an arm selectively movable downstream from the group 23 of yarn end disposing devices from a clearance position out of interference with the travel path of the main supply belt 7 to a peg tray diverting position generally transversely across the travel path of the main supply belt for diverting peg trays therefrom.

A transfer belt 81 is trained around a conventional guide roller 81″ and a conventional drive roller 81′, which is operatively connected to a drive motor 82 for driving operation of the endless member 81. The upstream end of the transfer belt 81 is disposed adjacent the main supply belt 7 for receiving peg trays diverted therefrom by the gate member 80. The downstream end of the transfer belt 81 is disposed adjacent the travel path of the final supply belt 28 for effecting the smooth transfer of peg trays from the transfer belt 81 to the final supply belt 28.

A main supply belt extension 85 is disposed on the same longitudinal side of the winding machine 1 as, and in alignment with, the main supply belt 7 and extends from an upstream end adjacent the downstream end of the main supply belt 7 to its downstream end at a location beyond the downstream of the downstream end of the final supply belt 28. This main supply belt extension 85 is trained around a conventional guide roller 85″ and a conventional drive roller 85′, which is operatively connected to a conventional drive motor 86 for driving operation of the endless member 85. The drive motor 86 is operatively connected via a connector 104′ to an auxiliary yarn end disposing device 104 identical in structure and operation to the auxiliary yarn end disposing device 47, illustrated in FIG. 11, is disposed along the travel path of the belt extension 85 for handling yarn packages supported on peg trays transported by the belt extension 85. A gate member 105 is disposed adjacent the travel path of the belt extension 85 and is operatively connected via a connector 87 to the auxiliary yarn end disposing device 104. The gate member 105 has an arm movable from a clearance position out of interference with the travel path of the belt extension 85 to a peg tray diverting position generally transversely across the travel path of the belt extension 85.

A sensor 90 for sensing the presence of a peg tray at a predetermined location along the travel path of the belt extension 85 is operatively connected via a connector 90′ to a control unit 121. The sensor 90 is disposed adjacent the belt extension member 85 for sensing yarn packages at a location downstream from the gate member 105.

A storage belt 88 is disposed on the end of the winding machine 1 remote from the spinning machine and extends generally transversely to the travel path of the belt extension 85 and is trained around a conventional guide roller 88″ and a conventional drive roller 88′, which is operatively connected to a conventional drive motor 89 for driving operation of the storage belt 88. The drive motor 89 is operatively connected via a connector 89′ to the control unit 121. An arcuately-shaped guide member 88‴ extends transversely across the travel path of the storage belt 88 for guiding movement of peg trays thereto. A sensor 120, operatively connected via a connector 120′ to the control unit 121, is disposed adjacent the storage belt 88 for sensing the presence of a peg tray at a predetermined downstream location.

A discharge belt 32, which is identical in its structure and operation to the discharge belt 32 of the embodiment shown in FIGS. 1–4, is disposed along the other longitudinal side of the winding machine 1 with its upstream end adjacent the downstream end of the storage belt 88. An arcuately-shaped guide member 88‴ extends transversely across the downstream end of the travel path of the storage belt 88 for guiding peg trays onto the discharge belt 32. A peg tray stop member 91 is disposed adjacent the travel path of the discharge belt 32 at a relatively short distance from its upstream end and is operatively connected via a connector 91′ to the control unit 121. The peg tray stop member 91 is operable to selectively prevent further movement of peg trays from the storage belt 88 along the discharge belt 32.

A sensor 92 is disposed adjacent the travel path of the discharge belt 32 downstream of the winding stations and is operatively connected via a connector 92′ to a gate member 93. The gate member 93 has an arm movable from a clearance position out of interference with the travel path of the discharge belt 32 to a position transversely across the travel path for diverting peg trays therefrom.

Another travel path in the form of a return belt 94 has its upstream end trained around a conventional guide roller 94'' and positioned adjacent the peg tray diverting location of the gate member 93. The downstream end of the return belt 94 is trained around a conventional drive roller 94' and is positioned adjacent the main supply belt 7 at a location upstream from the group 23 of yarn end disposing devices 20–22. The drive roller 94' is operatively connected to a conventional drive motor 95 for driving operation of the endless member 94.

A sensor 96 is disposed adjacent the travel path of the discharge belt 32 at a location downstream from the gate member 93 and is operatively connected via a connector 96' with a gate member 97 that has an arm movable between a clearance position out of interference with the travel path of the discharge belt 32 and a peg tray diverting position in which the arm is generally transversely disposed across the travel path of the discharge belt 32 for diverting peg trays therefrom to a transverse belt 98 trained around a conventional guide roller 98'' and a conventional drive roller 98', which is operatively connected to a conventional drive motor 99 for driving operation of the belt 98 transversely away from the discharge belt 32.

Another transverse belt 100 is disposed parallel to the first transverse belt 98 upstream with respect to the discharge belt 32 and trained around a conventional guide roller 100'' and a conventional drive roller 100', which is operatively connected to a conventional drive motor 101 for driving operation of the second transverse belt 100 toward the discharge belt 32. The downstream end of the second transverse belt 100 is positioned adjacent the discharge belt 32 at a location intermediate the gate members 93, 97 for the transfer of peg trays from the second transverse belt 100 to the discharge belt 32.

A conventional tube stripping device 42 is disposed along the travel path of the first transverse belt 98 for stripping yarn from tubes supported on peg trays transported by the belt 98. A semi-cylindrically shaped support member 102 extends from a location immediately downstream of the tube stripping device 42 to a location adjacent the travel path of the second transverse belt 100. The support member 102 supports peg trays for sliding movement therealong from the first transverse belt 98 to the second transverse belt 100 for return of peg trays that have passed through the tube stripping device 42 to the discharge belt 32.

The winding machine 1 includes an empty tube transfer device identical in operation and structure to the tube transfer device 69 of the embodiment shown in FIGS. 1–4 for transferring empty tubes to the spinning machine.

The integrated operation of the spinning machine, the winding machine 1 and the yarn package handling assembly of the embodiment shown in FIG. 5 is as follows. Full yarn packages are transferred from peg trays on the spinning machine to empty peg trays on the winding machine 1 in a full package transfer operation which is described in detail in the discussion of the embodiment illustrated in FIGS. 1–4. The peg trays supporting the full yarn packages then travel onto the main supply belt 7 shortly after receiving the full yarn packages and are transported thereby to the group 23 of yarn end disposing devices 20–22. Each full yarn package is successively handled by the yarn end disposing devices 20, 21 and 22. If the sensor 78 of the third yarn end disposing device 22 (FIG. 4) senses that a yarn end of a package has been successfully engaged by the suction action of the suction device 75, this sensing is regarded as an indication that the yarn end of the package has been successfully disposed in a preferred preliminary disposition and a signal is transmitted from the yarn end disposing device 22 via the connector 79 to the gate member 80 to cause the gate member to dispose its arm in its peg tray diverting position for diverting the peg tray supporting the respective sensed yarn package onto the transfer belt 81.

The transfer belt 81 transports the respective diverted peg tray directly from the main supply belt 7 to the final supply belt 28 for eventual feeding through the cyclically reversing movement of the final supply belt 28 to one of the winding station belts 3 for feeding of the full yarn package to a winding station.

If the sensor 28 of the yarn end disposing device 22 does not sense a yarn end of a yarn package supported at the yarn end disposing device, this absence of sensing is regarded as an indication that the yarn end of the respective yarn package has not been initially successfully disposed in a preferred preliminary disposition and a signal is transmitted in response to this absence of sensing via the connector 79 to the gate member 80. In response to the signal, the gate member 80 disposes its arm in its clearance position out of interference with the travel path of the main supply belt 7 and the peg tray supporting the respective yarn package is transported by the main supply belt 7 downstream beyond the gate member 80 and transferred at the downstream end of the main supply belt 7 to the upstream end of the main supply belt extension 85 for transport thereby to the auxiliary yarn end disposing device 104. The auxiliary yarn end disposing device 104 can be configured to transmit signals via the connector 104' to the drive motor 86 for controlling the driving operation of the belt extension 85 for selectively transporting peg trays to and from the auxiliary yarn handling device and for stopping the driving operation to retain a respective peg tray at the auxiliary yarn end handling device 104.

As seen in FIG. 6, the sensor 119 of the auxiliary yarn end disposing device 104 senses the presence or absence of a yarn end in the chamber 113 and transmits a corresponding signal via the connector 87 to the gate member 105. If the sensor 119 senses the presence of a yarn end, this sensing is regarded as an indication that the yarn end of the respective yarn package has been successfully disposed in a preferred preliminary disposition and the signal transmitted to the gate member 105 causes the gate member 105 to dispose its arm in its peg tray diverting disposition for diverting the peg tray supporting the respective yarn package onto a second transfer belt 83 for transport to the final supply belt 28. The second transfer belt 83 is rained around a conventional guide roller 83'' and a conventional drive roller 83', which is driven by a drive motor 84 to directly transport such diverted peg trays from the belt extension 85 to the final supply belt 28 for eventual feeding thereby to the belt 3 of one of the winding stations.

If the sensor 119 of the auxiliary yarn end disposing device 104 does not sense the presence of a yarn end in the chamber 113, this absence of sensing is regarded as an indication that a yarn end of the respective yarn package has not been successfully disposed in a preferred preliminary disposition and the corresponding signal transmitted to the gate member 105 causes the gate member to dispose its arm in its clearance position out of interference with the travel path of the belt extension 85 for permitting the peg tray supporting the respective yarn package to travel downstream beyond the gate member 105. The sensor 90 senses the presence of a peg tray disposed adjacent the sensor and transmits information regarding the presence or absence of a peg tray at the sensing location via the connector 90' to the control unit 121. The control unit 121 receives the information from the sensor 90 that indicates that a respective sensed peg tray is not moving downstream beyond the sensor 90, the control unit 121 concludes that the storage belt 88 which is stationary at this time, has peg trays thereon that resist receipt of further peg trays. The control unit 121 therefore controls the drive motor 89 via the connector 89' to drive the storage belt 88, ultimately causing peg trays to be guided by the arcuately shaped guide member 88''' from the storage belt 88 onto the discharge belt 32. The leading one of these downstream peg trays eventually moves into engagement with the peg tray stop member 91 and further movement of these peg trays along the travel path of the discharge belt 32 is thereby prevented. As the storage belt 88 is operated, it accepts new peg trays transferred thereto from the belt extension 85 and the control unit 121 stops the drive motor 89 after a predetermined period of operation. In this manner, the full capacity of the storage belt 88 to receive and temporarily store peg trays is fully utilized.

In the event that the sensor 90 still transmits a signal indicating that a respective peg tray at the sensing location is not moving therepast after the endless member 88 has been operated to transport the leadmost peg tray into engagement with the peg tray stop member 91, the control unit 121 evaluates this information from the sensor 90 as an indication that the endless member 88 is fully loaded with peg trays and has no further capacity to accept more peg trays. The control unit 121 then controls the peg tray stop member 91 to move from its peg tray stopping position to its clearance position for permitting peg trays to travel therepast on the discharge belt 32. The sensor 120 adjacent the travel path of the storage belt 88 senses the travel of peg trays therepast and, when a sufficient number of peg trays have been released downstream past the peg tray stop member 91, the sensor 120 senses that no further peg trays are traveling therepast and signals this information via the connector 120' to the control unit 121. In response to this signal, the control unit 121 stops the drive motor 89 to bring the storage belt 88 to a standstill. Additionally, the control unit 121 controls the peg tray stop member 91 to return to its peg tray stopping position.

Since, on average, the percentage of yarn packages of any given batch which cannot be successfully handled by the group 23 of yarn end disposing devices 20–22 or the auxiliary yarn end disposing device 104 comprise only a relatively small percentage of the total number of packages in the given batch, the capacity of the storage belt 88 should usually be sufficient to store this small percentage of yarn packages which have not had their yarn ends disposed in a preferred preliminary disposition until, for example, an operator is able to arrive at the winding machine 1 to manually dispose the yarn ends of these yarn packages in preferred preliminary dispositions. The control unit 121 may also be configured with conventional structure for manually overriding the automatic control functions of the control unit 121 to thereby permit an operator to selectively advance the storage belt 88.

The winding station belts 3 continuously feed peg trays to the discharge belt 32 following the handling of the yarn packages on the peg trays at the winding stations. It can be anticipated that, with any given batch of yarn packages being wound at the winding stations, a certain percentage of the yarn packages will not be completely unwound so that an amount of yarn will still remain on the tubes of these yarn packages following discharge from a winding station. The sensor 92, which is positioned downstream of the last winding station belt 3 with respect to the direction of travel of the discharge belt 32, is configured to sense the presence of a predetermined minimum amount of yarn on a tube being transported therepast. If the sensor 92 senses that a respective tube has more than the predetermined minimum amount of yarn, the sensor signals the gate member 93 via the connector 92' to move from its clearance position to its peg tray diverting position for diverting the peg tray supporting the respective sensed tube onto the return belt 94, which transports these peg trays directly to the main supply belt 7 upstream of the group 23 of the yarn end disposing devices 20–22 for further cycling of the incompletely unwound yarn packages to the winding stations.

On the other hand, if the sensor 92 senses that a tube traveling therepast has less than the predetermined minimum amount of yarn thereon, the sensor 92 controls the gate member 93 to remain in its clearance position to thereby permit the respective peg tray to travel downstream. The respective peg tray shortly thereafter is transported past the sensor 96 which senses whether the tube on the respective peg tray has any yarn remaining thereon. Since all of those yarn tubes having more than the predetermined minimum amount of yarn have previously been diverted by the gate member 93 from the discharge belt 32, only those tubes having less than the predetermined minimum amount of yarn (including tubes which are completely free of yarn) travel downstream to the sensor 96. If the sensor 96 detects the presence of yarn on a tube traveling therepast, it controls the gate member 97 via the connector 96' to move from its clearance position to its peg tray diverting position for diverting the respective peg tray onto the first transverse belt 98 for transport to the tube stripping device 42' for stripping of the remaining yarn from the tube supported on the respective peg tray and the peg tray, now supporting an empty tube thereon, is discharged from the tube stripping device 42 to slide along the support member 102 onto the second transverse belt 100 for transport thereby back onto the discharge belt 32 at a location upstream of the sensor 96. The discharge belt 32 moves the peg tray with its now-empty tube supported thereon past the sensor 96 again and the sensor 96 controls the arm member 97 to remain in its clearance position since the sensor senses that there is no yarn on the tube.

The peg trays with empty tubes thereon therefore travel downstream beyond the arm member 97 and exit the downstream end of the travel path of the discharge belt 32 adjacent the empty tube transfer location for transfer of the empty tubes from the winding machine 1 to the spinning machine in an empty tube transfer operation described in detail with respect to the embodiment shown in FIGS. 1–4.

Every peg tray transported on the discharge belt 32 is therefore re-circulated either to the main supply belt 7 with the empty tube having been removed by the above-described empty tube transfer device for yarn end processing and eventual feeding to the winding stations, to the return belt d94 to the main supply belt 7, or to the transverse belt 98 and tube stripping device 42' for stripping of yarn from the tube supported on the peg tray. The peg trays released for travel past the peg tray stop member 91 either support yarn packages whose yarn ends have been manually disposed in preferred preliminary dispositions by an operator or yarn packages whose yarn ends have not yet been successfully disposed in preferred preliminary dispositions. These two types of yarn packages are transported in a random, mixed manner with the yarn packages exiting the winding stations past the sensor 92 and are diverted by the gate member 93 onto the return belt 94 for further transport to the main supply belt 7 and subsequent further attempts to dispose their yarn ends in preferred preliminary dispositions or to feed the yarn packages to the winding stations.

In a modification of the embodiment shown in FIG. 5, the tube stripping device 42' can be provided with a conventional sensor for sensing if the tube stripper device has unsuccessfully stripped yarn from a tube. The sensor could be configured to cause guiding of the peg trays supporting such tubes to a location for storing the peg trays for eventual manual stripping of the yarn from the tubes. One such storage arrangement (shown in dot-dash lines in FIG. 5) may include a second storage belt 110 trained around a conventional guide roller 110" and a conventional drive roller 110', which is operatively connected to a conventional drive motor 111 for driving operation of the second storage belt 110 which extends in a travel path parallel to the travel path of the main supply belt 7 at a location on the winding machine intermediate the downstream end of the first transverse belt 98 and the main supply belt 7. A conventional peg tray support member extending from the downstream end of the transverse belt 98 to the upstream end of the second storage belt 110 could be provided to support peg trays for sliding movement from the transverse belt 98 to the second storage belt 110.

As a further modification of the embodiment shown in FIG. 5, a special yarn end disposing device 106 similar in structure and operation to the auxiliary yarn end disposing device 104, can be disposed along the travel path of the return belt 94 for handling yarn packages transported therealong. In this configuration of the yarn package handling assembly, the auxiliary yarn end disposing device 104 and the temporary storage arrangement including the storage belt 88 can be deleted. This further modification would also include providing a gate member 107 downstream from the special yarn end disposing device 106 and operatively connected thereto by a connector 106'. In the event that the sensor of the special yarn end disposing device 106 senses that the yarn end of a yarn package disposed thereat has not been successfully disposed in a preliminary preferred position, the special yarn end disposing device 106 can signal the gate member 107 via the connector 106' to divert the peg tray supporting the respective sensed yarn package onto the second storage belt 110 for storage thereon until an operator can manually execute a yarn end disposing operation.

In another modification of the embodiment shown in FIG. 5, a bypass belt 108 can be provided which is trained around a conventional guide roller 108" and a conventional drive roller 108', which is operatively connected to a conventional drive motor 109 for driving operation of the bypass belt 108. The upstream end of the bypass belt 108 can be positioned adjacent the travel path of the return belt 94 downstream of the special yarn end disposing device 106. A gate member 107" can be provided which is operatively connected via a connector 106" to the special yarn end disposing device 106 for diverting peg trays from the return belt 94 onto the bypass belt 98. A conventional peg tray guiding member 108"' can be provided for diverting peg trays from the bypass belt 108 onto the final supply belt 28. Accordingly, if the special yarn end disposing device 106 successfully disposes the yarn end of a respective yarn package in a preferred preliminary disposition, the gate member 107" can be operated to divert the peg tray onto the bypass belt 108 for transport thereby directly onto the final supply belt 28.

If a direct connection from the return belt 94 to the final supply belt 28 is provided by the bypass belt 108, the gate member 107 can be replaced with a conventional arcuately shaped peg tray guiding member 110"' since all the peg trays exiting the special yarn end disposing device 106 which are not guided by the gate member 107" onto the bypass belt 108 for transport thereby to the final supply belt 28 will be shunted onto the storage belt 110.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a winding machine having a plurality of winding stations for winding yarn from yarn packages of the type formed from yarn built onto tubes, the tubes being supported by a plurality of package support members in upright dispositions, an assembly for handling yarn packages to prepare the yarn packages for unwinding at the winding stations and to prepare unwound tubes for transfer from the winding machine as empty tubes, comprising:

means for transporting package support members with yarn packages thereon along a supply travel path to the winding stations;

yarn end disposing means disposed along said supply travel path for disposing the yarn end of a yarn package in a preferred preliminary disposition for engagement at a winding station; and another yarn end disposing means for disposing the yarn end of a yarn package in a preferred preliminary disposition for engagement at a winding station, said transporting means transporting package support members from said another yarn end disposing means along another travel path.

2. In a winding machine, the yarn package handling assembly according to claim 1 and characterized further in that said first-mentioned yarn end disposing means and said another yarn end disposing means have different operating characteristics for yarn end disposing.

3. In a winding machine, the yarn package handling assembly according to claim 2 and characterized further in that said another yarn end disposing means is disposed for receiving yarn packages having yarn ends that were not properly disposed by said first-mentioned yarn end disposing means.

4. In a winding machine, the yarn package handling assembly according to claim 3 and characterized further in that said transporting means transports package support members from said winding stations along a discharge travel path and said another travel path extends from said discharge travel path to said supply travel path.

5. In a winding machine, the yarn package handling assembly according to clain 4 and characterized further by sensing means for sensing the disposition of yarn ends of packages after travel through said first-mentioned yarn end disposing means, and means responsive to said sensing means for guiding to said another travel path those package support members having yarn packages with yarn ends that were not properly disposed by said first-mentioned yarn end disposing means.

6. In a winding machine, the yarn package handling assembly according to claim 5 and characterized further by sensing means for sensing the disposition of yarn ends of packages after travel through said another yarn end disposing means, means responsive to said sensing means for guiding from said another travel path package support members having yarn packages with yarn ends that were not properly disposed by said another yarn end disposing means, and storage means for receiving and storing package support members guided from said another travel path by said guiding means.

7. In a winding machine, the yarn package handling assembly according to claim 4 and characterized further by yarn amount sensing means located along said discharge travel path for sensing a predetermined minimum amount of yarn on a tube on a package support member traveling therepast, and package support member diverting means responsive to said yarn amount sensing means for diverting package support members supporting tubes having more than said predetermined minimum amount of yarn thereon from said discharge travel path to said another path.

8. In a winding machine, the yarn package handling assembly according to claim 7 and characterized further by residual yarn sensing means located along said discharge travel path downstream of said yarn amount sensing responsive diverting means for sensing the presence of residual yarn on tubes on package support members traveling therepast, package support member diverting means responsive to said residual yarn sensing means for diverting package support members supporting tubes having residual yarn thereon from said discharge path, and tube stripper means for stripping residual yarn from tubes on package support members diverted by said residual yarn diverting means.

9. In a winding ,machine, the yarn package handling assembly according to claim 8 and characterized further in that said tube stripping means includes means for transporting package support members through said tube stripping means and returning them to said discharge path upstream from said residual yarn sensing means.

10. In a winding machine, the yarn package handling assembly according to claim 8 and characterized further in that said tube stripping means includes means for sensing tubes that have not been successfully stripped of yarn by said tube stripping means and means for storing package support members supporting unsuccessfully stripped tubes thereon without return to said discharge travel path.

11. In a winding machine, the yarn package handling assembly according to claim 7 and characterized further by yarn amount sensing means located along said discharge travel path for sensing the presence of yarn on a tube on a package support member traveling therepast, package support member diverting means responsive to said yarn sensing means for diverting package support members supporting tubes with yarn thereon to said another travel path, residual yarn sensing means located along said another travel path for sensing the presence of less than a predetermined amount of yarn on a tube supported by a package support member traveling therepast, package support member diverting means responsive to said residual yarn sensing means for diverting package support members supporting tubes having residual yarn thereon less than a predetermined amount from said another travel path, and tube stripper means for stripping yarn from tubes on package support members diverted by said residual yarn diverting means, said tube stripper means including means for transporting package support members through said tube stripping means and returning them to said discharge travel path.

12. In a winding machine, the yarn package handling assembly according to claim 11 and characterized further in that said transporting means of said tube stripper means returns the transported package support members to said discharge travel path upstream of said yarn sensing means.

13. In a winding machine, the yarn package handling assembly according to claim 1 and characterized further in that said transporting means transports said package support members along said another travel path to said supply travel path.

14. In a winding machine, the yarn package handling assembly according to claim 1 and characterized further in that at least one of said yarn end disposing means includes means for mechanically loosening a yarn end from a yarn package and means for applying a suction action substantially along the entire axial extent of a yarn package to engage a loosened yarn end thereon.

15. In a winding machine, the yarn package handling assembly according to claim 1 and characterized further in that said another yarn end disposing means includes a chamber positionable circumferentially about an upper axial portion of the yarn packages for applying a suction action thereto to effect loosening of a yarn end.

16. In a winding machine, the yarn package handling assembly according to claim 1 and characterized further in that said supply travel path is a main supply travel path, said transporting means includes a plurality of intermediate supply travel paths for transport of package support members from said main supply travel path to said winding stations, and there being a plurality of the first-mentioned yarn end disposing means, each of said first-mentioned yarn end disposing means being disposed along a different one of said intermediate supply travel paths, and means for selectively guiding each package support member from said main supply travel path to a selected intermediate supply path.

17. In a winding machine, the yarn package handling assembly according to claim 1 and characterized further by sensing means for sensing yarn packages on package support members on said supply travel path upstream of said first-mentioned yarn end disposing means for sensing a predetermined package condition and guiding means responsive to said sensing means to guide package support members from said supply travel path to said another yarn end disposing means.

18. In a winding machine, the yarn package handling assembly according to claim 1 and characterized further by guiding means for selectively guiding package support members from said supply travel path upstream of said first-mentioned yarn end disposing means to said another yarn end disposing means to increase the utilization thereof.

19. In a winding machine, the yarn package handling assembly according to claim 1 and characterized further by guiding means for guiding package support embers having packages with yarn spun at the end of a yarn batch from said supply travel path upstream of said first mentioned yarn end disposing means to said another yarn end disposing means to increase the utilization thereof.

* * * * *